US009340035B2

(12) United States Patent
Sudo et al.

(10) Patent No.: US 9,340,035 B2
(45) Date of Patent: May 17, 2016

(54) INK JET PRINTER AND RECORDING METHOD

(71) Applicant: Seiko Epson Corporation, Tokyo (JP)

(72) Inventors: Naoki Sudo, Shiojiri (JP); Akito Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/636,436

(22) Filed: Mar. 3, 2015

(65) Prior Publication Data

US 2015/0258807 A1 Sep. 17, 2015

(30) Foreign Application Priority Data

Mar. 17, 2014 (JP) ..... 2014-053840

(51) Int. Cl.
*B41J 29/38* (2006.01)
*B41J 2/21* (2006.01)

(52) U.S. Cl.
CPC ..... *B41J 2/2146* (2013.01); *B41J 2/2139* (2013.01)

(58) Field of Classification Search
CPC ..... B41J 2/04526; B41J 2/0453
See application file for complete search history.

(56) References Cited

U.S. PATENT DOCUMENTS

| | | | | |
|---|---|---|---|---|
| 7,903,290 | B2 * | 3/2011 | Faken et al. | 358/3.03 |
| 2005/0083361 | A1 * | 4/2005 | Nakanishi et al. | 347/12 |
| 2006/0139394 | A1 * | 6/2006 | Wada | 347/19 |

FOREIGN PATENT DOCUMENTS

JP 2006-076086 A 3/2006

* cited by examiner

*Primary Examiner* — Shelby Fidler
*Assistant Examiner* — Tracey McMillion

(57) ABSTRACT

An ink jet printer in which a plurality of nozzles includes a failed nozzle that fails to discharge an ink droplet, a primary vicinal nozzle that forms a dot in an adjacent pixel which is adjacent in a direction intersecting a scanning direction to a dot-missing pixel which is caused by the failed nozzle and is continuous in the scanning direction, and a secondary vicinal nozzle that forms a dot in a secondary adjacent pixel which is adjacent to the adjacent pixel on the opposite side of the adjacent pixel from the dot-missing pixel, and a dot formation unit forms a dot by displacing the position of a dot formed by an ink droplet from the primary vicinal nozzle in the scanning direction and the position of a dot formed by an ink droplet from the secondary vicinal nozzle in the scanning direction.

9 Claims, 10 Drawing Sheets

INK JET PRINTER AND RECORDING METHOD

CROSS-REFERENCE TO RELATED APPLICATIONS

This application claims priority to Japanese Patent Application No. 2014-053840 filed on Mar. 17, 2014. The entire disclosure of Japanese Patent Application No. 2014-053840 is hereby incorporated herein by reference.

BACKGROUND

1. Technical Field

The present invention relates to an ink jet printer and a recording method.

2. Related Art

An ink jet printer, as an example, moves a plurality of nozzles lined up in a predetermined line-up direction of nozzles and a print material relatively in a scanning direction that is orthogonal to the line-up direction of nozzles and allows the nozzle to discharge ink droplets in accordance with data to be recorded that represents presence or absence of a dot for each pixel, thus forming dots on the print material. In addition, a line printer is known to form a print image by transporting a print material without moving nozzles that are arranged substantially across the entirety of the print material in a width direction of the print material which is orthogonal to a transport direction of the print material to perform high-speed printing. When obturation or the like causes a nozzle not to discharge ink droplets, or ink droplets discharged do not draw the correct trajectory thereof, a "dot-missing" area in which pixels where a dot is not formed are connected in the scanning direction is formed, and streaking of the color of the print material that is called white streaking occurs in the print image. Particularly, a line printer is a type of ink jet printers that does not have a nozzle to hit ink droplets directly at dot-missing pixels which are continuous in the scanning direction due to failed nozzles which fail to discharge ink droplets. Thus, streaking easily occurs along the scanning direction in the print image.

Increasing the amount of ink droplets discharged from two normal nozzles that are adjacent to a failed nozzle when compared with an ordinary case is reviewed to suppress streaking described above (for example, refer to JP-A-2006-76086). When the amount of ink droplets discharged from adjacent nozzles is increased, dots formed at pixels that are adjacent to the dot-missing pixels in the line-up direction of nozzles become large.

Ink droplets that hit the print material behave as liquid until soaking into the print material or dried. For this reason, liquid ink droplets that hit a secondary adjacent pixel which is adjacent to an adjacent pixel on the opposite side of the adjacent pixel from the dot-missing pixel attract ink droplets that hit the adjacent pixel toward the opposite side from the dot-missing pixel, and the effect of complementation in which complemental dots formed in the adjacent pixel suppresses streaking in the print image may be weakened.

Such a problem described above is not limited to a line printer and also resides in various ink jet printers similarly.

SUMMARY

An advantage of some aspects of the invention is to provide a technology that can improve the effect of complementing a dot formed by a failed nozzle which fails to form a dot.

According to an aspect of the invention, there is provided an ink jet printer in which a plurality of nozzles lined up in a different direction from a scanning direction and a print material relatively move in the scanning direction to form a dot using an ink droplet, the ink jet printer including a complemental unit that generates data to be recorded in which a dot is complemented in an adjacent pixel on the basis of original data before complementation of a dot formed by a failed nozzle, and a dot formation unit that forms a dot by allowing the plurality of nozzles to discharge an ink droplet on the basis of the data to be recorded, in which the plurality of nozzles includes the failed nozzle that fails to discharge an ink droplet, a primary vicinal nozzle that forms a dot in the adjacent pixel which is adjacent in a direction intersecting the scanning direction to a dot-missing pixel which is caused by the failed nozzle and is continuous in the scanning direction, and a secondary vicinal nozzle that forms a dot in a secondary adjacent pixel which is adjacent to the adjacent pixel on the opposite side of the adjacent pixel from the dot-missing pixel, and the dot formation unit forms a dot by displacing the position of a dot formed by an ink droplet from the primary vicinal nozzle in the scanning direction and the position of a dot formed by an ink droplet from the secondary vicinal nozzle in the scanning direction.

According to another aspect of the invention, there is provided a recording method in which a plurality of nozzles lined up in a different direction from a scanning direction and a print material are allowed to relatively move in the scanning direction to form a dot using an ink droplet, the recording method including complementing by generating data to be recorded in which a dot is complemented in an adjacent pixel on the basis of original data before complementation of a dot formed by a failed nozzle, and dot forming by forming a dot by allowing the plurality of nozzles to discharge an ink droplet on the basis of the data to be recorded, in which the plurality of nozzles includes the failed nozzle that fails to discharge an ink droplet, a primary vicinal nozzle that forms a dot in the adjacent pixel which is adjacent in a direction intersecting the scanning direction to a dot-missing pixel which is caused by the failed nozzle and is continuous in the scanning direction, and a secondary vicinal nozzle that forms a dot in a secondary adjacent pixel which is adjacent to the adjacent pixel on the opposite side of the adjacent pixel from the dot-missing pixel, and in the dot forming, a dot is formed by displacing the position of a dot formed by an ink droplet from the primary vicinal nozzle in the scanning direction and the position of a dot formed by an ink droplet from the secondary vicinal nozzle in the scanning direction.

Here, an area configured by a plurality of adjacent pixels that is continuous in the scanning direction is called an adjacent area, and an area configured by a plurality of secondary adjacent pixels that is continuous in the scanning direction is called a secondary adjacent area. When each of the positions of dots formed in the adjacent area and the secondary adjacent area are displaced in the scanning direction, the hitting position of ink droplets in the adjacent area and the hitting position of ink droplets in the secondary adjacent area are separated. Accordingly, ink droplets that hit the adjacent area are hardly attracted by ink droplets that hit the secondary adjacent area. Therefore, the present aspect can provide a technology that can improve the effect of complementing dots that have to be formed by the failed nozzle which fails to discharge ink droplets.

Furthermore, the invention can be applied to a complex apparatus that includes an ink jet printer, an image forming program that realizes functions corresponding to each unit described above in a computer, a program like a printing program that includes the image forming program, a computer-readable recording medium on which these programs are recorded, and the like. The apparatus described above may be configured by a plurality of distributed components.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
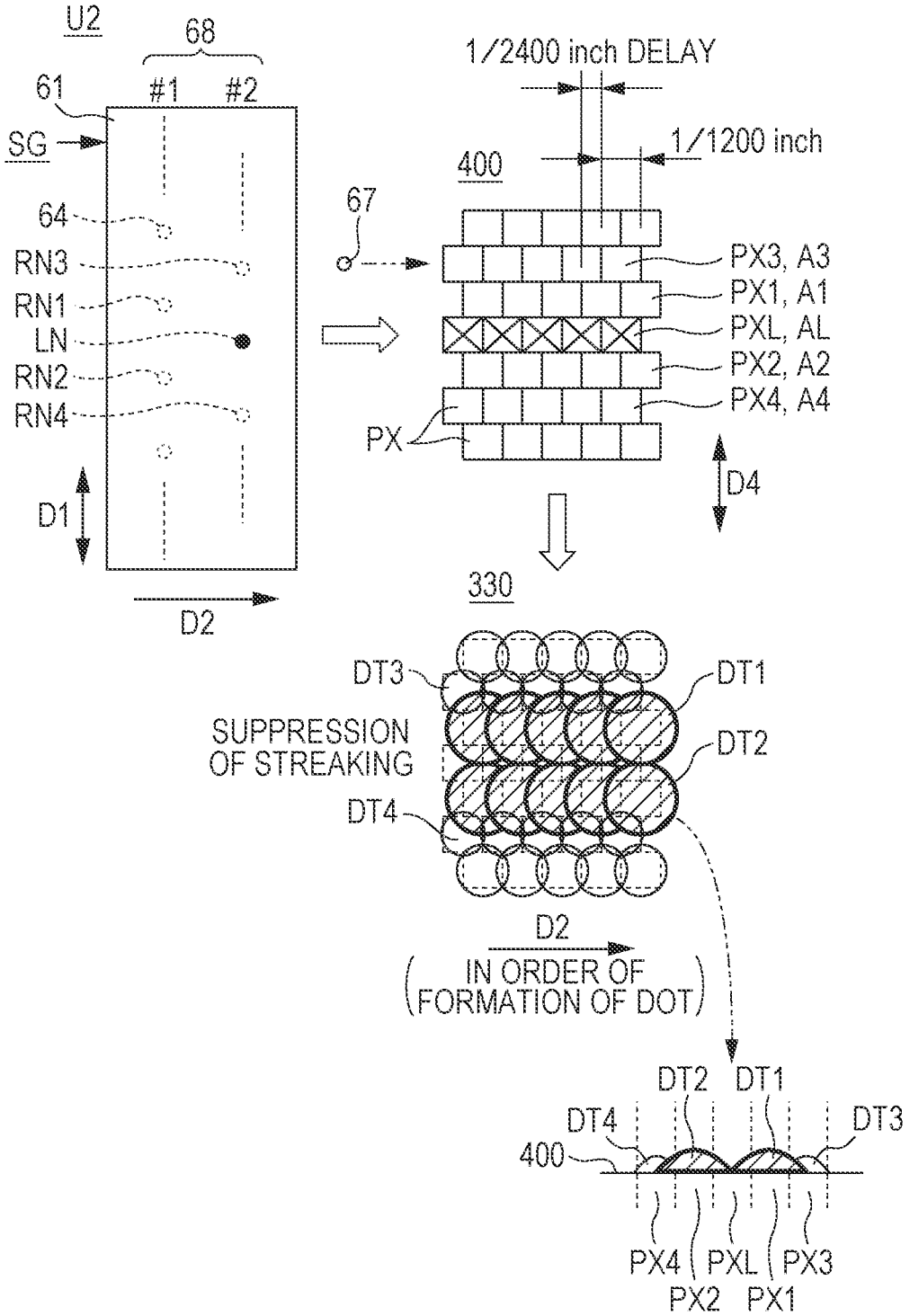
FIG. 1 is a diagram schematically illustrating an example of formation of an image by displacing the position of dots in an adjacent area and a secondary adjacent area in a scanning direction.

An embodiment of the invention is described hereinafter. Obviously, the embodiment below is merely illustration of the invention, and every feature illustrated in the embodiment is not necessarily essential in the solution of the invention.

1. Outline of Present Technology

First, an outline of the present technology is described with reference to FIGS. 1 to 10.

In an ink jet printer 1 of the present technology, a plurality of nozzles 64 that is lined up in a direction (D1) which is different from a scanning direction (D2) and a print material 400 relatively move in the scanning direction (D2) to form a dot DT using an ink droplet 67. Here, the scanning direction (D2) when "relative movement" is mentioned includes a transport direction (D3) of the print material 400 in a line printer. Relative movement of the nozzle 64 and the print material 400 includes a case where the nozzle 64 does not move, and the print material 400 moves as in a line printer, a case where the print material 400 does not move, and the nozzle 64 moves, and a case where both the nozzle 64 and the print material 400 move. The nozzle is a small hole from which an ink droplet is ejected. The print material (print substrate) is a material that holds a print image. The shape thereof is generally a rectangle and may be a circle (for example, an optical disc such as a CD-ROM, a DVD, and the like), a triangle, a quadrangle, a polygon, and the like. The shape includes at least types or processed products of paper or paperboard described in JIS P0001:1998 (a vocabulary regarding paper, paperboard, and pulp). A resin sheet, a metal plate, a three-dimensional material, and the like are also included in the print material. The dot is the smallest unit of an image formed on the print material by an ink droplet.

The plurality of nozzles 64 includes a failed nozzle LN that fails to discharge ink droplets, primary vicinal nozzles RN1 and RN2 (means at least one of the RN1 and the RN2 hereafter) that form a dot at adjacent nozzles PX1 and PX2 (means at least one of the PX1 and the PX2 hereafter), and secondary vicinal nozzles RN3 and RN4 (means at least one of the RN3 and the RN4 hereafter) that form a dot at secondary adjacent pixels PX3 and PX4 (means at least one of the PX3 and the PX4 hereafter). The adjacent pixels PX1 and PX2 are pixels that are adjacent to dot-missing pixels PXL which are caused by the failed nozzle LN and are continuous in the scanning direction (D2) in a direction (width direction D4) intersecting the scanning direction (D2). The secondary adjacent pixels PX3 and PX4 are pixels that are adjacent to the adjacent pixels PX1 and PX2 on the opposite side of the adjacent pixels PX1 and PX2 from the dot-missing pixel PXL. Here, a failure of discharge of ink droplets includes obturation (clogging) that is a phenomenon in which a nozzle is blocked. The pixel is the smallest constituent of an image, and color can be independently assigned thereto.

A complemental unit U1 of the ink jet printer 1 generates data to be recorded 310 in which dots are complemented in the adjacent pixels PX1 and PX2 on the basis of original data 300 before complementation of dots formed by the failed nozzle LN. Dots complemented in the adjacent pixels PX1 and PX2 include any of a dot that becomes larger from a dot before complementation and a dot that does not exist before complementation and is newly formed. A dot formation unit U2 of the ink jet printer 1 allows the plurality of nozzles 64 to discharge the ink droplet 67 to form the dot DT on the basis of the data to be recorded 310. The dot formation unit U2 forms dots by displacing the position of dots DT1 and DT2 (means at least one of the DT1 and the DT2 hereafter) that are formed by the ink droplet 67 from the primary vicinal nozzles RN1 and RN2 in the scanning direction (D2) and the position of dots DT3 and DT4 (means at least one of the DT3 and the DT4 hereafter) that are formed by the ink droplet 67 from the secondary vicinal nozzles RN3 and RN4 in the scanning direction (D2).

Accordingly, the hitting position of the ink droplet 67 in adjacent areas A1 and A2 (means at least one of the A1 and the A2 hereafter) and the hitting position of the ink droplet 67 in secondary adjacent areas A3 and A4 (means at least one of the A3 and the A4 hereafter) are separated.

Figure 10:
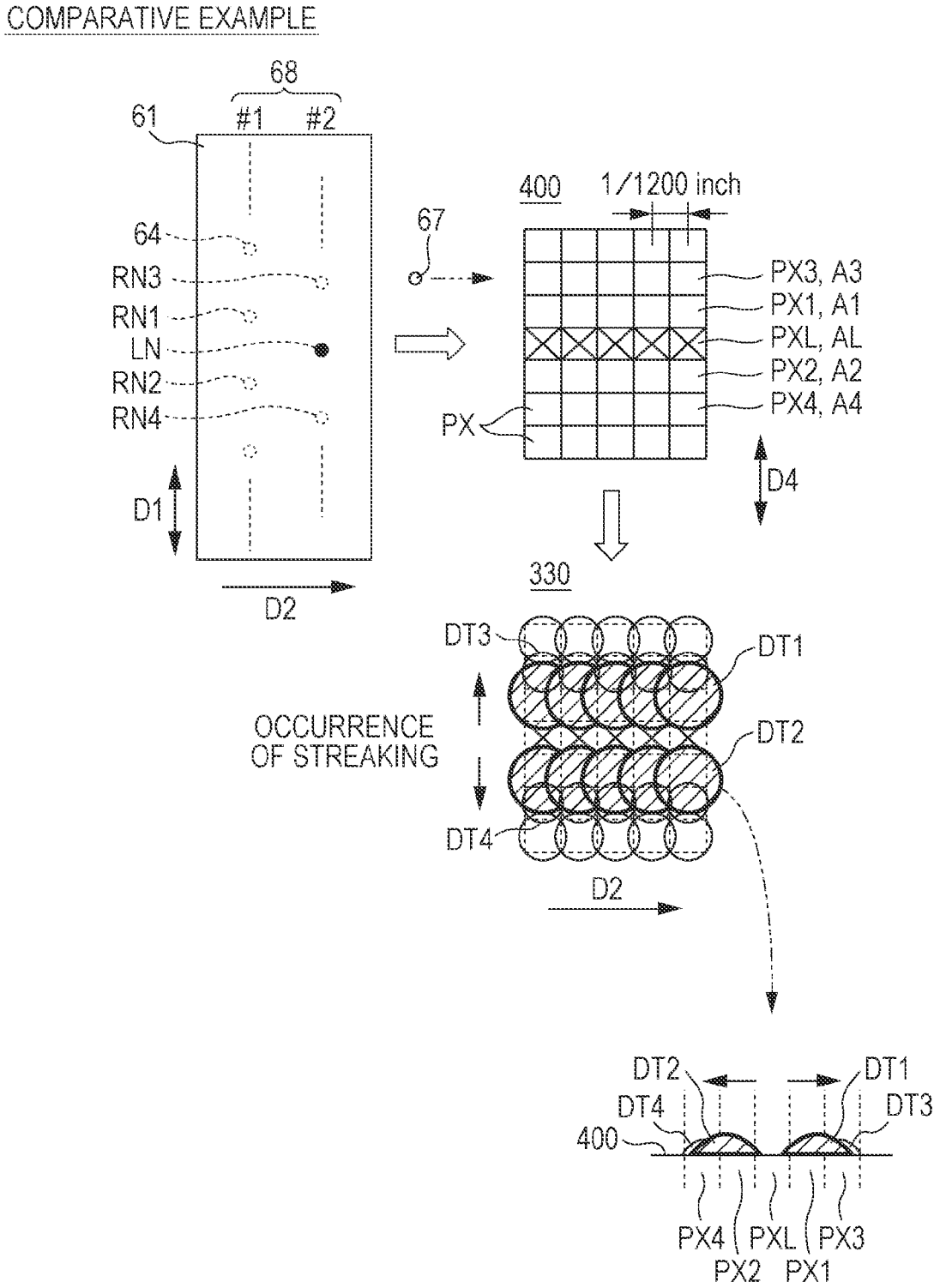
FIG. 10 is a diagram schematically illustrating an example of formation of an image in a comparative example.

FIG. 10 schematically illustrates a comparative example in which the position of the dots DT1 and DT2 formed by the primary vicinal nozzle in the scanning direction and the position of the dots DT3 and DT4 formed by the secondary vicinal nozzle in the scanning direction are not displaced. The dots DT1 and DT2 formed in the adjacent pixels PX1 and PX2 are hatched. The ink droplet 67 that hits the print material 400 behaves as liquid until socking into the print material 400 or dried. For this reason, liquid ink droplets that hit the secondary adjacent pixels PX3 and PX4 attract ink droplets that hit the adjacent pixels PX1 and PX2 toward the opposite side from the dot-missing pixel PXL as illustrated in FIG. 10, and the complemental dots DT1 and DT2 formed in the adjacent areas A1 and A2 may approach the secondary adjacent areas A3 and A4. In this case, the effect of complementation in which complemental dots formed in the adjacent pixels PX1 and PX2 cover the dot-missing pixel PXL is weakened. Such a phenomenon noticeably appears in non-absorbent media into which ink does not soak such as a polyethylene terephthalate (PET) paper and the like or a print material into which ink slowly soaks such as a glossy paper and the like.

The plurality of nozzles 64 may be arranged in a zigzag form as the first array #1 of the nozzles 64 and the second array #2 of the nozzles 64. The secondary vicinal nozzles RN3 and RN4 may be arranged in the second array #2 to which ink droplets are discharged first, and the primary vicinal nozzles RN1 and RN2 may be arranged in the first array #1 to which ink droplets are discharged subsequently. In this case, ink droplets that hit the adjacent areas A1 and A2 are easily attracted by liquid ink droplets that first hit the secondary adjacent areas A3 and A4, and weakening of the effect of complementation described above easily occurs.

Meanwhile, in the present technology, the hitting position of ink droplets in the adjacent areas A1 and A2 and the hitting position of ink droplets in the secondary adjacent areas A3 and A4 are displaced and separated in the scanning direction as illustrated in FIG. 1. Thus, ink droplets that hit the adjacent areas A1 and A2 are hardly attracted by ink droplets that hit the secondary adjacent areas A3 and A4. Accordingly, a dot-missing area AL is easily covered by the complemented dots DT1 and DT2 formed in the adjacent pixels PX1 and PX2, and streaking in the print image is suppressed. Therefore, the present embodiment can provide a technology that can improve the effect of complementing dots that have to be formed by the failed nozzle LN.

Figure 7:
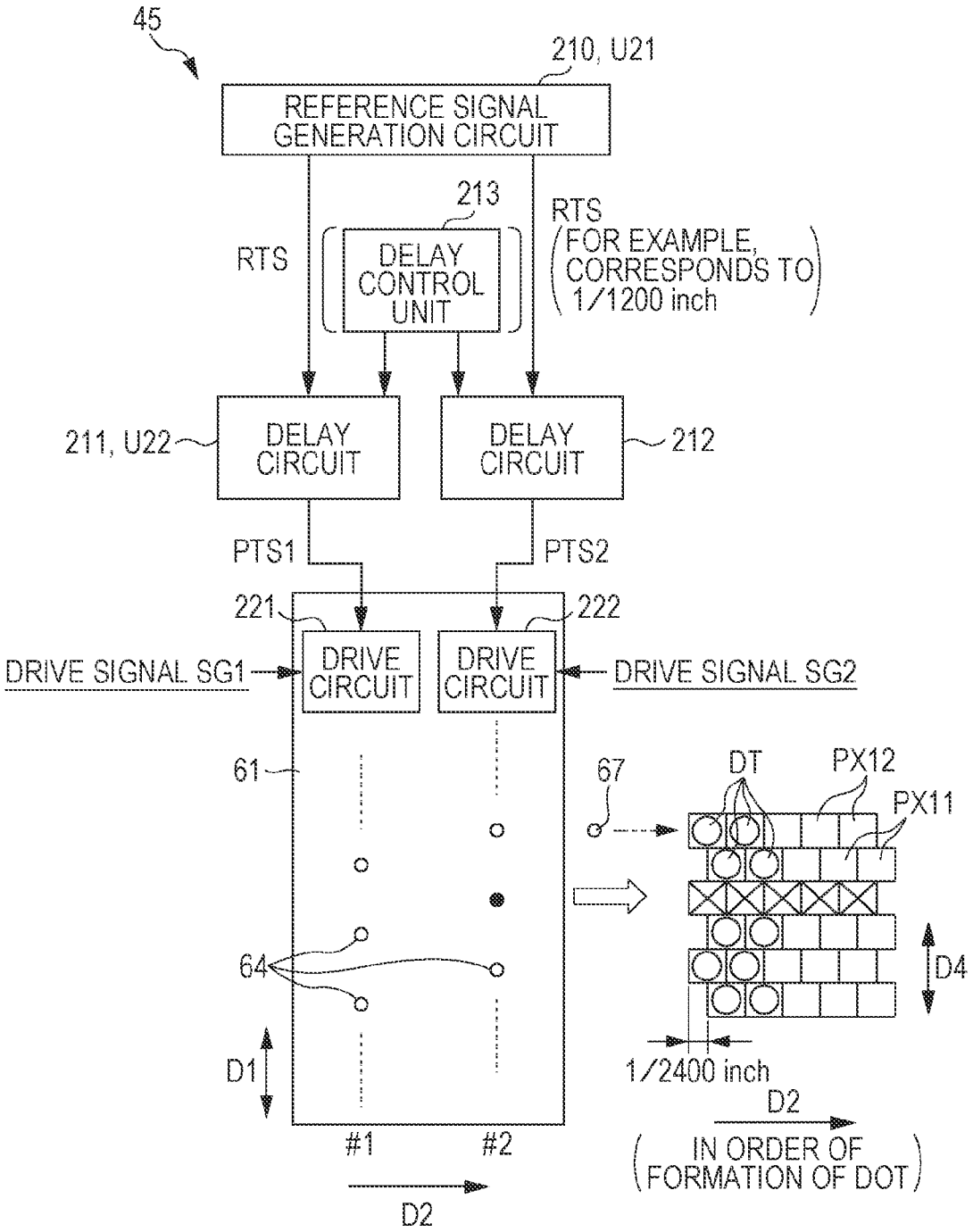
FIG. 7 is a diagram schematically illustrating an example of displacement of a discharge timing of an ink droplet.

As illustrated in FIG. 7, the dot formation unit U2 may include a discharge interval control unit U21 that controls the discharge timing of the ink droplet 67 from the plurality of nozzles 64 to be within a predetermined discharge interval (for example, corresponds to 1/1200 inch). In addition, the dot formation unit U2 may include a discharge delay unit U22 that delays the discharge timing of the ink droplet 67 from the primary vicinal nozzles RN1 and RN2 within the range of the discharge interval (for example, corresponds to 1/2400 inch). By delaying the discharge timing of the ink droplet 67 from the primary vicinal nozzles RN1 and RN2 within the range of the discharge interval, the hitting position of the ink droplet 67 is adjusted more finely than the resolution (for example, 1200 dpi) of the data to be recorded 310 in the scanning direction (D2) without changing the resolution. Accordingly, the hitting position of ink droplets in the adjacent areas A1 and A2 is displaced from the hitting position of ink droplets in the secondary adjacent areas A3 and A4, and ink droplets that hit the adjacent areas A1 and A2 are hardly attracted by ink droplets that hit the secondary adjacent areas A3 and A4. Therefore, the present embodiment can improve the effect of complementing dots that have to be formed by the failed nozzle LN without increasing the resolution of the data to be recorded 310. In addition, the speed of a printing process can be maintained since the resolution of the data to be recorded 310 may not be increased. Furthermore, the amount of delay of the discharge timing can be variously set within the range of the discharge interval by considering the quality and the like of the print image.

Here, only the discharge timing of the primary vicinal nozzles RN1 and RN2 may be delayed, and the discharge timing of other nozzles 64 except the secondary vicinal nozzles RN3 and RN4 may also be delayed.

The plurality of nozzles 64 may be arranged in a zigzag form as the first array #1 of the nozzles 64 and the second array #2 of the nozzles 64 from which the ink droplet 67 is discharged earlier than from the first array #1 of the nozzles 64. The primary vicinal nozzles RN1 and RN2 may be included in the first array #1 of the nozzles 64, and the secondary vicinal nozzles RN3 and RN4 may be included in the second array #2 of the nozzles 64. In this case, the discharge delay unit U22 may delay the discharge timing of the ink droplet 67 from the first array #1 of the nozzles 64 within the range of the discharge interval.

When the plurality of nozzles 64 is arranged in a zigzag form, there are an array of nozzles 64 (second array #2) that discharge the ink droplet 67 first and an array of nozzles 64 (first array #1) that discharge the ink droplet 67 subsequently. When ink droplets hit the adjacent areas A1 and A2 after ink droplets hit the secondary adjacent areas A3 and A4, ink droplets that hit the adjacent areas A1 and A2 subsequently tend to be easily attracted by ink droplets that hit the secondary adjacent areas A3 and A4 first. Therefore, when the discharge timing of ink droplets from the first array #1 of the nozzles 64 including the primary vicinal nozzles RN1 and RN2 is delayed within the range of the discharge interval, the difference between the time of hitting of ink droplets is increased, and the hitting position of ink droplets in the adjacent areas A1 and A2 is displaced from the position of ink droplets that hit the secondary adjacent areas A3 and A4 first in the scanning direction (D2). Accordingly, the present embodiment can complement dots that have to be formed by the failed nozzle LN more appropriately.

Figure 9:
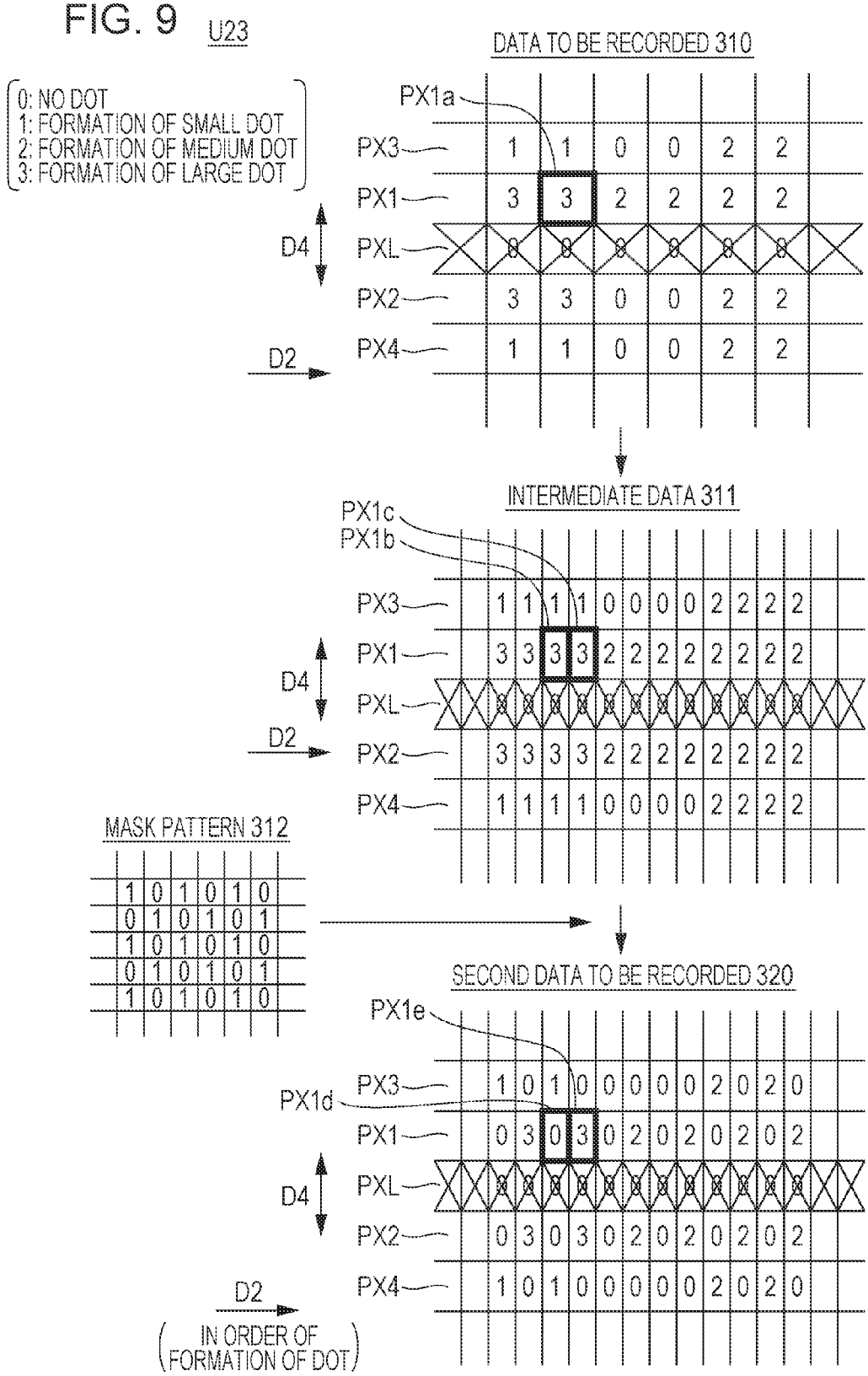
FIG. 9 is a diagram schematically illustrating a flow of a data conversion process.

As illustrated in FIG. 9, the complemental unit U1 may generate the data to be recorded 310 that is a first resolution (for example, 1200 dpi) in the scanning direction (D2) on the basis of the original data 300. The dot formation unit U2 may include a data conversion unit U23 that converts the first resolution into a second resolution (for example, 2400 dpi) which is double the first resolution in the scanning direction (D2) by continuously lining up each pixel PX of the data to be recorded 310 in the scanning direction (D2) on the basis of the data to be recorded 310, arranges original data of each pixel for every two pixels in the scanning direction (D2) and data for not forming a dot in the remaining pixels, and generates second data to be recorded 320 in which the positions of the original data of each pixel in the adjacent pixels PX1 and PX2 and in the secondary adjacent pixels PX3 and PX4 are differently positioned from each other in the scanning direction (D2). Then the dot formation unit U2 may allow the plurality of nozzles 64 to discharge the ink droplet 67 according to the second data to be recorded 320 that has the second resolution in the scanning direction (D2) to form the dot DT.

That is, dots are formed at different positions from each other in the adjacent areas A1 and A2 and in the secondary adjacent areas A3 and A4 in the scanning direction (D2) according to the second data to be recorded 320. Thus, ink droplets that hit the adjacent areas A1 and A2 are hardly attracted by ink droplets that hit the secondary adjacent areas A3 and A4. Accordingly, the present embodiment can improve the effect of complementing dots that have to be formed by the failed nozzle LN without using a circuit that delays the discharge timing of ink droplets from the nozzles 64.

When the plurality of nozzles 64 is arranged in a zigzag form, the primary vicinal nozzles RN1 and RN2 are included in the first array #1 of the nozzles 64, and the secondary vicinal nozzles RN3 and RN4 are included in the second array #2 of the nozzles 64, the data conversion unit U23 may generate the second data to be recorded 320 by setting dots to be formed later at the position of the original data of each pixel in the adjacent pixels PX1 and PX2 than at the position of the original data of each pixel in the secondary adjacent pixels PX3 and PX4. As described above, when ink droplets hit the adjacent areas A1 and A2 after ink droplets hit the secondary adjacent areas A3 and A4, ink droplets that hit the adjacent areas A1 and A2 subsequently tend to be easily attracted by ink droplets that hit the secondary adjacent areas A3 and A4 first. In the present embodiment, the discharge timing of ink droplets from the first array #1 of the nozzles 64 including the primary vicinal nozzles RN1 and RN2 is actually delayed by a time corresponding to one pixel in the second resolution. Thus, the difference between the time of hitting of ink droplets is increased, and the position of ink droplets that hit the adjacent areas A1 and A2 subsequently is displaced from the position of ink droplets that hit the secondary adjacent areas A3 and A4 first. Accordingly, the present embodiment can complement dots that have to be formed by the failed nozzle LN more appropriately.

When the ink jet printer 1 is a line printer that allows the plurality of nozzles 64 to discharge the ink droplet 67 to the moving print material 400, there doesn't exist any nozzle 64 that allows the ink droplet 67 to directly hit the dot-missing pixels PXL which are caused by the failed nozzle LN and are continuous in the scanning direction (D2). Thus, streaking of the dot-missing pixels PXL tends to easily occur in the print image. Accordingly, an embodiment in which the ink jet printer 1 is a line printer is an exemplary embodiment that improves the effect of complementing dots which have to be formed by the failed nozzle LN.

2. First Specific Example of Ink Jet Printer and Recording Method

Figure 2:
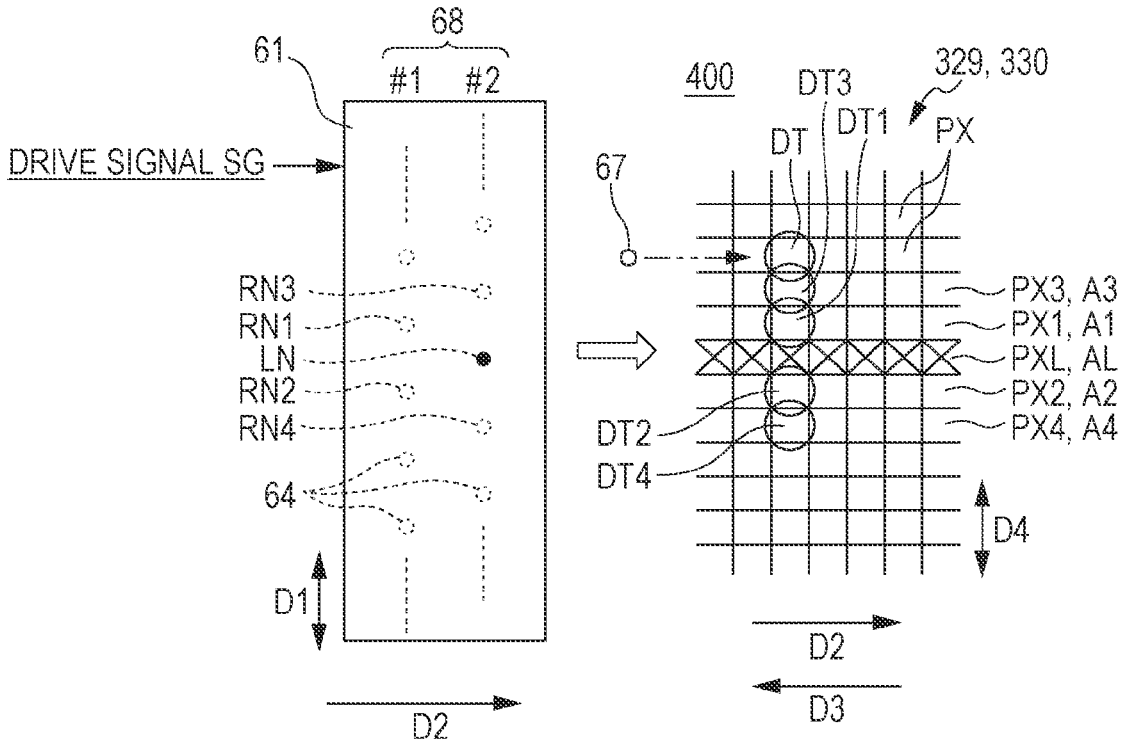
FIG. 2 is a diagram schematically illustrating an example of a correspondence between a nozzle and a pixel.
Figure 3:
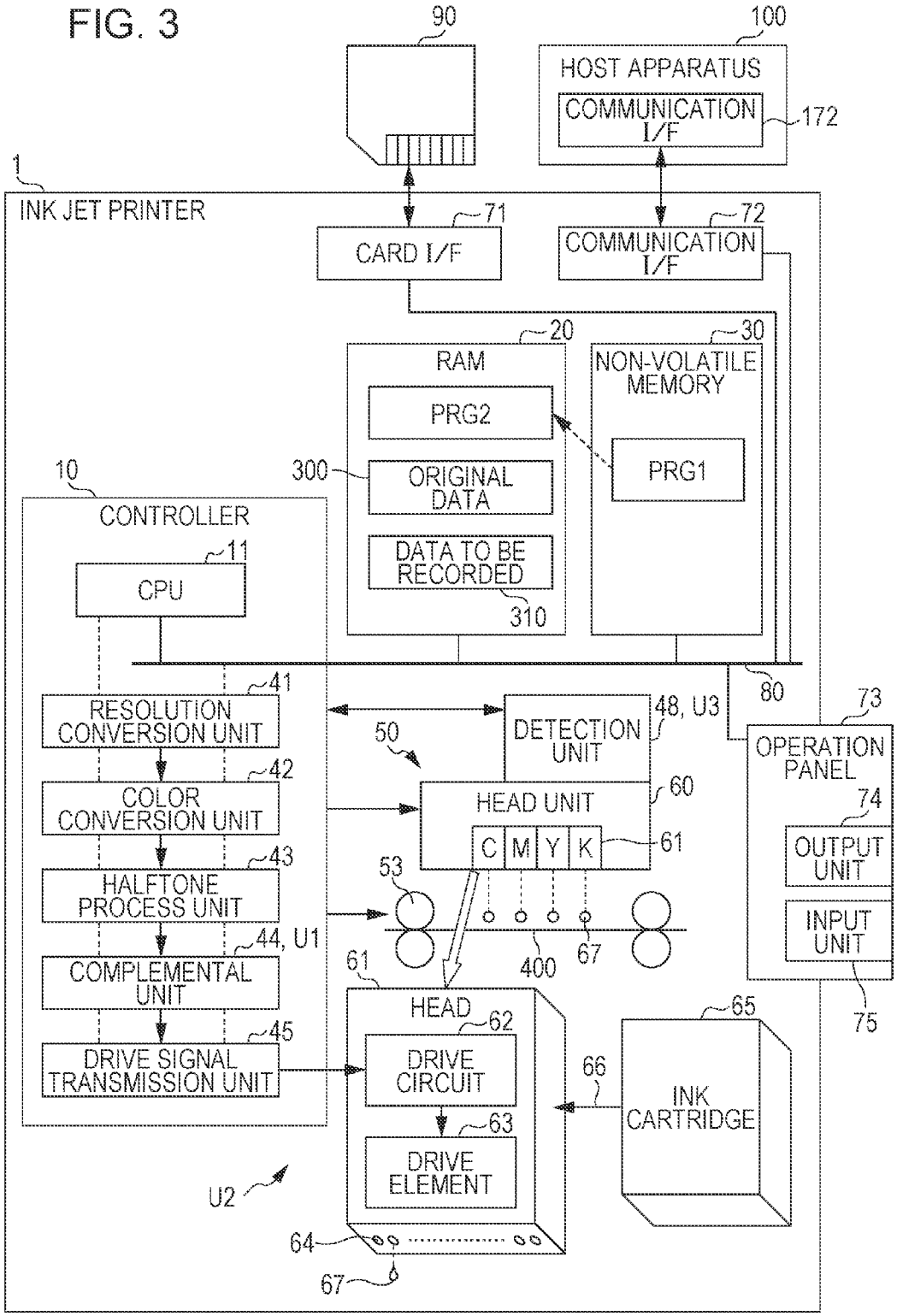
FIG. 3 is a diagram schematically illustrating an example of the configuration of an ink jet printer.
Figure 4:
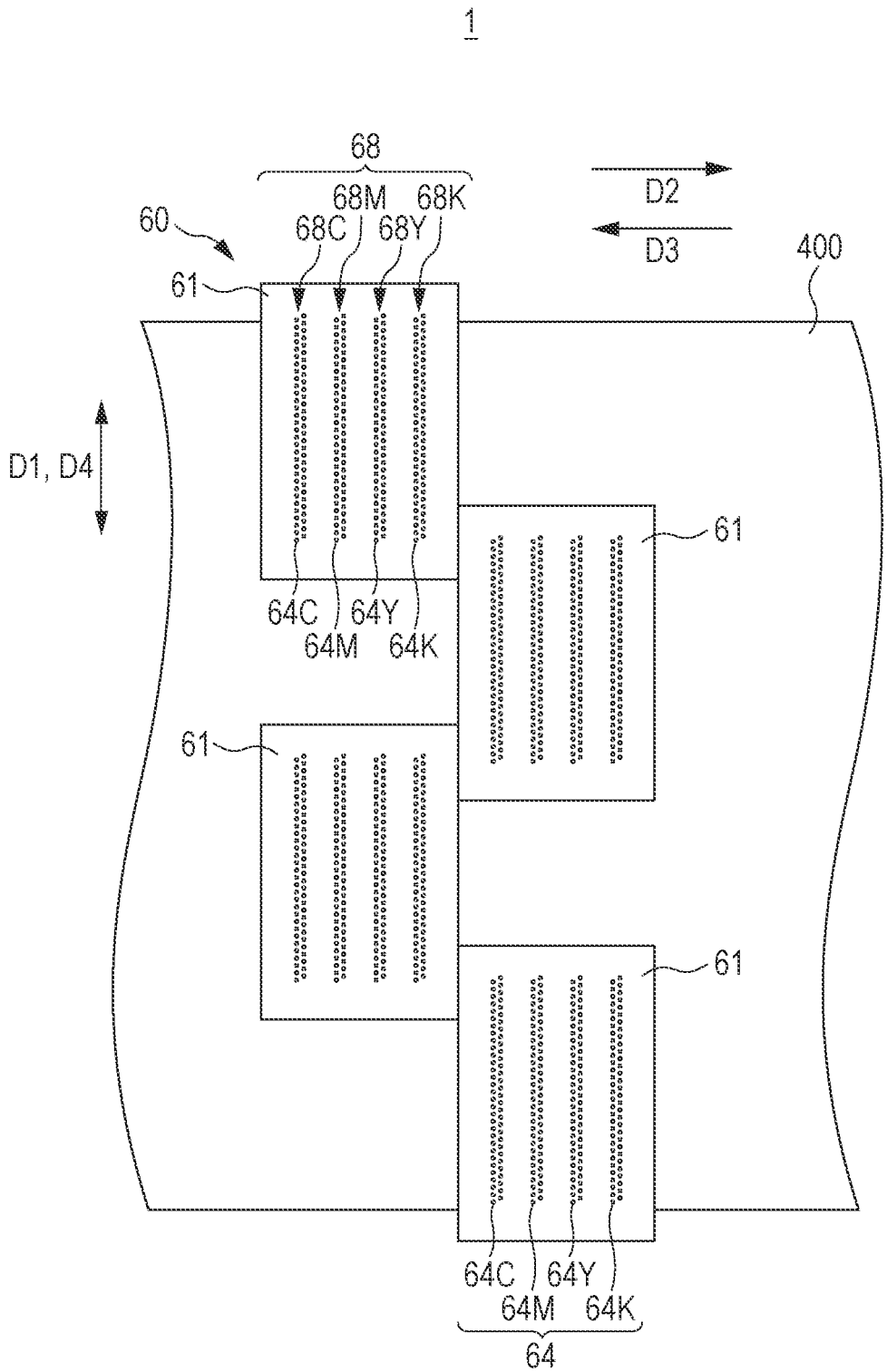
FIG. 4 is a diagram schematically illustrating a main portion of a line printer as the ink jet printer.

FIG. 1 schematically illustrates an example of formation of a print image 330 by displacing the position of dots in the adjacent areas A1 and A2 and in the secondary adjacent areas A3 and A4 in the scanning direction. FIG. 2 schematically illustrates an example of a correspondence between the nozzle 64 and the pixel PX. FIG. 3 schematically illustrates an example of the configuration of the ink jet printer 1. FIG. 4 schematically illustrates a main portion of a line printer as the ink jet printer 1. In the present specification, the reference sign D1 indicates the line-up direction of the nozzles 64, the reference sign D2 indicates the scanning direction in a narrow meaning that means the order of formation of the dot DT, the reference sign D3 indicates the transport direction that is opposite to the scanning direction D2 in a narrow meaning, and the reference sign D4 indicates the width direction of the long print material 400. The line-up direction D1 and the width direction D4 are the same in the example in FIG. 4 and the like, but the line-up direction D1 and the width direction D4 may be different. These directions D1 and D4 and the scanning direction D2 (transport direction D3) may intersect each other, and not only a case of orthogonality therebetween but also a case of non-orthogonality therebetween are included in the invention. Deviation from strict orthogonality due to error is included in the orthogonality. For easy understanding, the magnification of each direction may be different, and the drawings may not be coordinated with each other. In addition, dots illustrated in FIG. 1 and the like are schematically illustrated just for description. The size, shape, or the like of dots actually formed is not necessarily the same as that in the drawings. A head 61 illustrated in FIGS. 1 to 5 and the like is also schematically illustrated just for description. The size, shape, or the like thereof is not necessarily the same as that in these drawings. Furthermore, the pitch between pixels may be different in the width direction D4 and the scanning direction D2 although the pitch between pixels that is an interval between the arrangement of the center of the pixel is substantially the same in the width direction D4 and the scanning direction D2 in FIG. 1 and the like.

The ink jet printer 1 generates the data to be recorded 310 that represents the print image 330 in which dots which have to be formed by the failed nozzle LN are complemented on the basis of the original data 300 that represents an imaginary image 329 before complementation of dots which is not formed actually. The images 329 and 330 before and after complementation are images with multiple values or two values that represent the status of formation (includes presence or absence) of the dot DT for each pixel PX which are orderly lined up in each of the scanning direction D2 and the width direction D4. The print image 330 is an image that is actually formed on the print material 400.

First, an example of a correspondence between the nozzle 64 and the pixel PX is described. A head unit 60 illustrated in FIG. 4 includes the recording head 61 that includes a nozzle array 68C of cyan (C), a nozzle array 68M of magenta (M), a nozzle array 68Y of yellow (Y), and a nozzle array 68K of black (K). The head 61 may be disposed separately for each color of C, M, Y, and K. Each of the nozzle arrays 68C, 68M, 68Y, and 68K is lined up in the transport direction D3 of the print material 400 such as a print paper and the like. The head unit 60 is fixed not to move. Thus, the scanning direction D2 in a narrow meaning is a direction that is opposite to the transport direction D3. In each of the nozzle arrays 68C, 68M, 68Y, and 68K, nozzles 64C, 64M, 64Y, and 64K are lined up in the line-up direction D1. Even in a case of a nozzle array in which nozzles are arranged in a zigzag form, a plurality of nozzles is lined up in a predetermined line-up direction that is different from the scanning direction, for example, lined up in two arrays, and this is included in the present technology. The line-up direction in this case means a direction in which each of the arrays of nozzles is lined up in the zigzag arrangement.

In the head unit 60 illustrated in FIG. 4, a plurality of heads 61 is arranged so that the dot DT is formed on the print material 400 by the ink droplet 67 that is discharged (ejected) from the nozzles 64C, 64M, 64Y, and 64K across the entire print material 400 in the width direction D4. Here, the nozzle arrays 68C, 68M, 68Y, and 68K are collectively called a nozzle array 68, and the nozzles 64C, 64M, 64Y, and 64K are collectively called the nozzle 64.

In FIG. 2 and the like, an example of the head 61 that includes the nozzle array 68 in which the plurality of nozzles 64 is arranged in a zigzag form along the line-up direction D1 is schematically illustrated. The head 61 is illustrated on the opposite side from a nozzle surface that includes the nozzle 64 to be in accordance with the print image 330. The nozzle array 68 illustrated in FIG. 2 and the like illustrates the arrangement of the plurality of nozzles 64 for one color among C, M, Y, and K. In the nozzle array 68, the first array #1 of the nozzles arranged on an upstream side of the scanning direction D2 and the second array #2 of the nozzles from which the ink droplet 67 is discharged earlier than from the first array #1 of the nozzles 64 are included. When the failed nozzle LN exists in the second array #2, the primary vicinal nozzles RN1 and RN2 exist in the first array #1, and the secondary vicinal nozzles RN3 and RN4 exist in the second array #2. In this case, ink droplets discharged from the secondary vicinal nozzles RN3 and RN4 first hit the secondary adjacent areas A3 and A4, and ink droplets that are delayed and discharged from the primary vicinal nozzles RN1 and RN2 hit the adjacent areas A1 and A2.

The failed nozzle LN in which ink droplets are not discharged because of obturation or the like, or ink droplets discharged do not draw a correct trajectory may occur in the nozzle array 68. When the failed nozzle LN exists, a "dot-missing" area (dot-missing area AL) in which the dot-missing pixels PXL in which the dot DT is not formed are connected in the scanning direction D2 is formed on the print material 400 as illustrated in FIG. 2 and the like. That is, a plurality of pixels PX that constitutes the image 330 to be formed includes the dot-missing pixels PXL that are caused by the failed nozzle LN included in the plurality of nozzles 64 and are continuous in the scanning direction D2. Streaking of the color of the print material 400 occurs in the print image 330 along the scanning direction D2 because of the dot-missing area AL. When the print material 400 is white, white streaking occurs.

In the present technology, vicinal nozzles that are adjacent to both sides of the failed nozzle LN in the line-up direction D1 are called the primary vicinal nozzles RN1 and RN2, vicinal nozzles that are adjacent to the primary vicinal nozzles RN1 and RN2 on the opposite side of the primary vicinal nozzles RN1 and RN2 from the failed nozzle LN are respectively called the secondary vicinal nozzles RN3 and RN4, vicinal pixels that are adjacent to both sides of the dot-missing pixel PXL in the width direction D4 are called the adjacent pixels PX1 and PX2, and vicinal pixels that are adjacent to the adjacent pixels PX1 and PX2 on the opposite side of these adjacent pixels PX1 and PX2 from the dot-missing pixel PXL are respectively called the secondary adjacent pixels PX3 and PX4. The dots DT1, DT2, DT3, and DT4 are formed respectively in the pixels PX1, PX2, PX3, and PX4 by the ink droplet 67 discharged from the nozzles RN1, RN2, RN3, and RN4.

The ink jet printer 1 illustrated in FIG. 3 includes a controller 10, a random access memory (RAM) 20, a non-volatile memory 30, a failed nozzle detection unit 48, a mechanism unit 50, interfaces (I/F) 71 and 72, an operation panel 73, and the like. The controller 10, the RAM 20, the non-volatile memory 30, the I/Fs 71 and 72, and the operation panel 73 are connected to a bus 80 and are capable of inputting and outputting information to each other.

The controller 10 includes a central processing unit (CPU) 11, a resolution conversion unit 41, a color conversion unit 42, a halftone process unit 43, a complemental unit 44 (U1), a drive signal transmission unit 45, and the like. The controller 10 constitutes the dot formation unit U2 with the mechanism unit 50 and constitutes a failed nozzle detection portion U3 with the failed nozzle detection unit 48. The controller 10 can be configured by a system on a chip (SoC) and the like.

The CPU 11 is a device that centrally performs an information process or control in the ink jet printer 1.

The resolution conversion unit 41 converts the resolution of an input image from a host apparatus 100, a memory card 90, or the like into a set resolution (for example, 600 dpi in the width direction D4 and 1200 dpi in the scanning direction D2). The input image, for example, is represented by RGB data that has an integer value with 256 gradations of RGB (red, green, and blue) for each pixel.

The color conversion unit 42, for example, converts the RGB data of the set resolution into CMYK data that has an integer value with 256 gradations of C, M, Y, and K for each pixel.

The halftone process unit 43 performs a predetermined halftone process such as dithering, error diffusion, and density patterning for a gradation value of each pixel that constitutes the CMYK data to decrease a gradation number of the gradation value and generates the original data 300 before complementation of dots formed by the failed nozzle LN. The original data 300 is data that represents the status of formation of dots. The original data 300 may be two-value data that represents whether to form a dot or not or may be multi-value data with three or more gradations that can correspond to the different sizes of a dot like each of large, medium, and small dots. Two-value data that can represent each pixel with one bit, for example, can be set as data in which formation of a dot is associated with one and no dot with zero. Four-value data that can represent each pixel with two bits, for example, can be set as data in which formation of a large dot is associated with three, formation of a medium dot with two, formation of a small dot with one, and no dot with zero. When a large dot is dedicatedly used as a complemental dot, the original data 300 may be multi-value data in which a large dot is not formed.

The complemental unit 44 generates the data to be recorded 310 in which dots are complemented in the adjacent pixels PX1 and PX2 on the basis of the original data 300. Accordingly, the data to be recorded 310 is also data that represents the status of formation of dots. Thus, the data to be recorded 310 may be two-value data or may be multi-value data with three or more gradations.

The drive signal transmission unit 45 generates a drive signal SG that corresponds to a voltage signal applied to a drive element 63 of the head 61 from the data to be recorded 310 and outputs the drive signal SG to a drive circuit 62. For example, a drive signal for discharging an ink droplet for a large dot is output when the data to be recorded 310 is "formation of a large dot", a drive signal for discharging an ink droplet for a medium dot is output when the data to be recorded 310 is "formation of a medium dot", and a drive signal for discharging an ink droplet for a small dot is output when the data to be recorded 310 is "formation of a small dot". Each of these units 41 to 45 may be configured by an application-specific integrated circuit (ASIC), may read data for a process target directly from the RAM 20, and may write processed data directly into the RAM 20.

The mechanism unit 50 controlled by the controller 10 includes a paper transport mechanism 53, the head unit 60, the head 61, and the like and constitutes the dot formation unit U2 with the controller 10. The paper transport mechanism 53 transports the print material 400 that is continuous in the scanning direction D2 in the transport direction D3. The head 61 that discharges the ink droplet 67 of, for example, C, M, Y, and K is mounted on the head unit 60. The head 61 includes the drive circuit 62, the drive element 63, and the like. The drive circuit 62 applies a voltage signal to the drive element 63 in accordance with the drive signal SG that is input from the controller 10. A piezoelectric element that applies a pressure to ink 66 in a pressure chamber which communicates with the nozzle 64, a drive element that generates air bubbles in the pressure chamber with heat and allows the nozzle 64 to discharge the ink droplet 67, or the like can be used in the drive element 63. The ink 66 is supplied to the pressure chamber of the head 61 from an ink cartridge 65. A combination of the ink cartridge 65 and the head 61, for example, is disposed for each of C, M, Y, and K. The ink 66 in the pressure chamber is discharged as the ink droplet 67 by the drive element 63 from the nozzle 64 toward the print material 400, and the dot DT is formed by the ink droplet 67 on the print material 400 such as a print paper and the like. By the print material 400 being transported in the transport direction D3, that is, by the plurality of nozzles 64 and the print material 400 moving relatively in the scanning direction, the print image 330 that corresponds to the data to be recorded 310 is formed by a plurality of dots DT. When the multi-value data is four-value data, the image 330 is printed by formation of dots in accordance with the size of dots represented in the multi-value data.

The RAM 20 is a volatile semiconductor memory with a large capacity and stores a program PRG2, the original data 300, the data to be recorded 310, and the like. The program PRG2 includes an image forming program that realizes, in the ink jet printer 1, a complementation function, a dot formation function, and a failed nozzle detection function that correspond to each of the units U1 to U3 of the ink jet printer 1.

Program data PRG1 and the like are stored in the non-volatile memory 30. A magnetic recording medium such as a read-only memory (ROM) and a hard disk or such a medium is used in the non-volatile memory 30. Loading the program data PRG1 means writing the program data PRG1 into the RAM 20 as a program that can be interpreted by the CPU 11.

The card I/F 71 is a circuit that writes data into a memory card 90 or reads data from the memory card 90. The memory card 90 is a non-volatile semiconductor memory in which data can be written and deleted and stores an image and the like that are photographed by a photographic device like a digital camera. The image, for example, is represented with a pixel value in an RGB color space, and each of the pixel values of R, G, and B, for example, is represented with an eight-bit gradation value ranging from zero to 255.

The communication I/F 72 is connected to a communication I/F 172 of the host apparatus 100 and inputs and outputs information to the host apparatus 100. A Universal Serial Bus (USB) and the like can be used in the communication I/Fs 72 and 172. The host apparatus 100 includes a computer like a personal computer, a digital camera, a digital video camera, a cellular phone like a smartphone, and the like.

The operation panel 73 includes an output unit 74, an input unit 75, and the like. A user can input various instructions to the ink jet printer 1 through the operation panel 73. The output unit 74, for example, is configured by a liquid crystal panel (display unit) that displays information in accordance with various instructions or information indicating the state of the ink jet printer 1. The output unit 74 may output these pieces of information as a voice. The input unit 75, for example, is configured by operation keys (operation input unit) such as a cursor key and a determination key. The input unit 75 may be a touch panel or the like that receives an operation on a display screen.

The failed nozzle detection unit 48 constitutes the failed nozzle detection portion U3 with the controller 10. The failed nozzle detection portion U3 detects whether the state of each nozzle 64 is normal or failure.

Figure 5A:
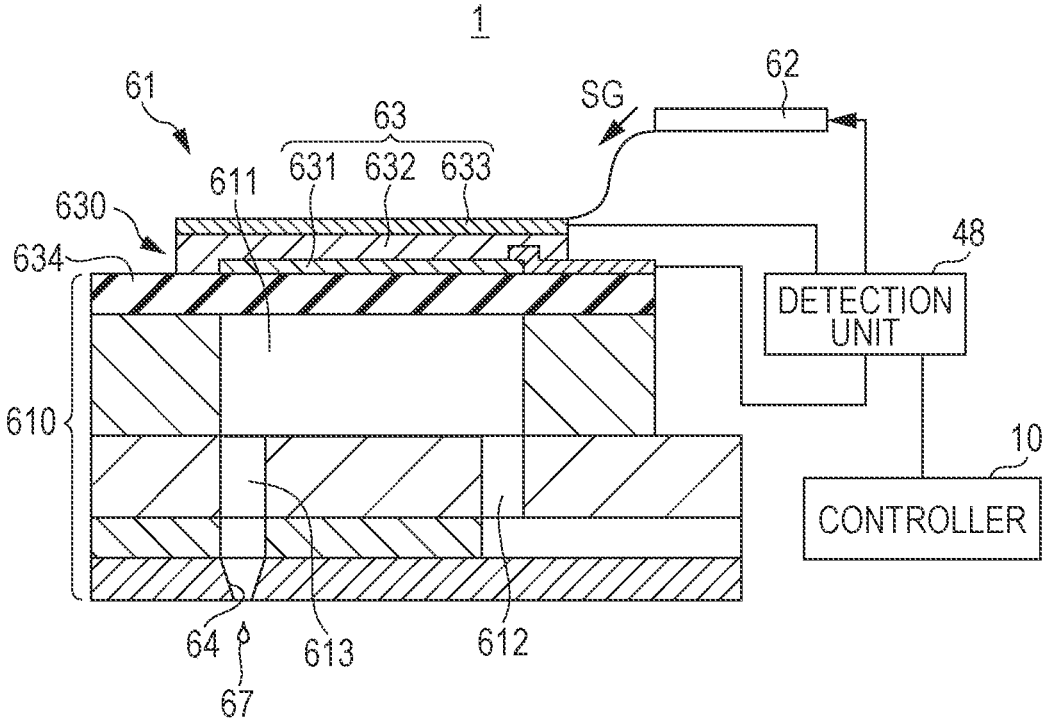
FIG. 5A is a diagram schematically illustrating a main portion of the ink jet printer.
Figure 5B:
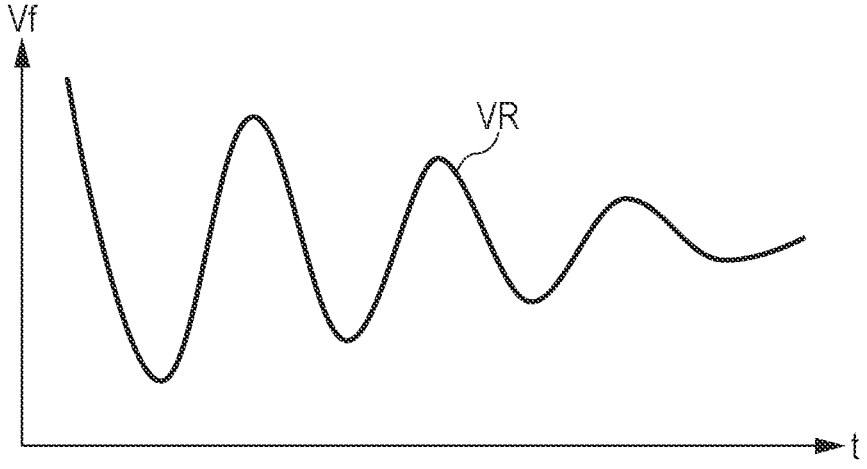
FIG. 5B is a diagram schematically illustrating a curve of electromotive force on the basis of residual vibrations of a vibrating plate.
Figure 6A:
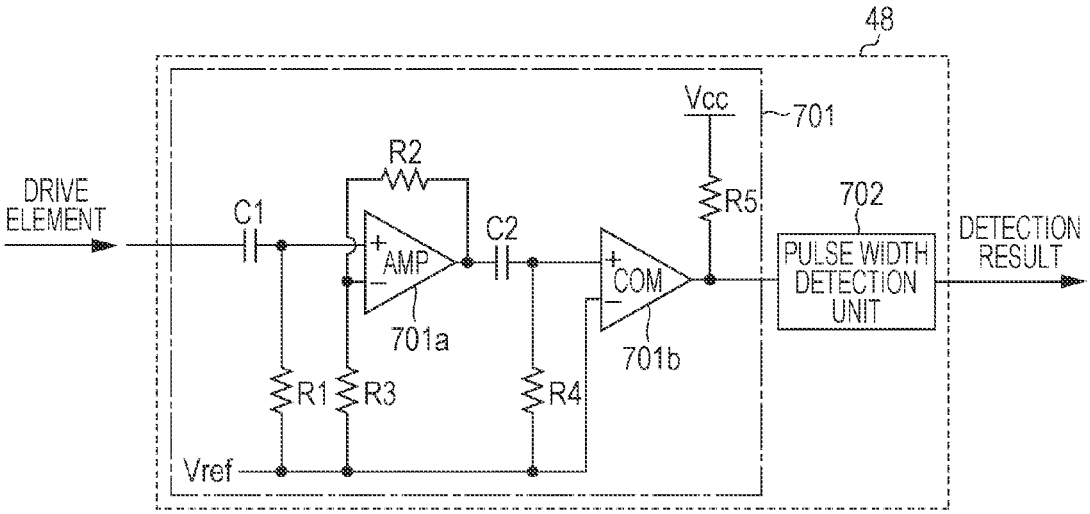
FIG. 6A is a diagram illustrating an example of an electrical circuit of a failed nozzle detection unit.
Figure 6B:
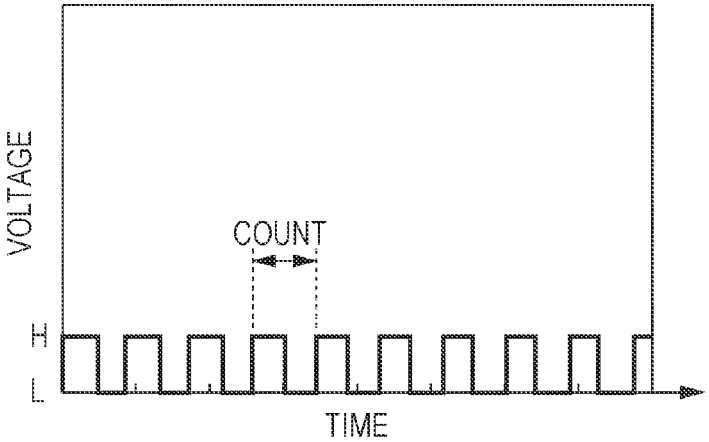
FIG. 6B is a diagram schematically illustrating an example of an output signal from an amplification unit.

FIGS. 5A and 5B are diagrams for describing an example of a method for detecting the state of the nozzle 64. FIG. 5A schematically illustrates a main portion of the ink jet printer 1, and FIG. 5B schematically illustrates a curve of electromotive force VR on the basis of residual vibrations of a vibrating plate 630. FIG. 6A illustrates an example of an electrical circuit of the detection unit 48, and FIG. 6B schematically illustrates an example of an output signal from a comparator 701*b*.

A pressure chamber 611, an ink supply passage 612 through which the ink 66 flows into the pressure chamber 611 from the ink cartridge 65, a nozzle communication passage 613 through which the ink 66 flows into the nozzle 64 from the pressure chamber 611, and the like are formed in a flow passage substrate 610 of the head 61 illustrated in FIG. 5A. A silicon substrate and the like, for example, can be used in the flow passage substrate 610. The surface of the flow passage substrate 610 is a vibrating plate portion 634 that constitutes a part of a wall surface of the pressure chamber 611. The vibrating plate portion 634, for example, can be configured of a silicon oxide and the like. The vibrating plate 630, for example, can be configured by the vibrating plate portion 634, the drive element 63 formed on the vibrating plate portion 634, and the like. A piezoelectric element or the like that, for example, includes a lower electrode 631 that is formed on the vibrating plate portion 634, a piezoelectric body layer 632 that is substantially formed on the lower electrode 631, and an upper electrode 633 that is substantially formed on the piezoelectric body layer 632 can be used as the drive element 63. Platinum, gold, or the like, for example, can be used in the electrodes 631 and 633. In the piezoelectric body layer 632, for example, a ferroelectric perovskite oxide or the like such as a PZT (a lead zirconate titanate, a stoichiometric ratio of $Pb(Zr_x, Ti_{1-x})O_3$) can be used.

FIG. 5A, as a block diagram, illustrates the main portion of the ink jet printer 1 in which the detection unit 48 that detects the state of electromotive force from the piezoelectric element (drive element 63) on the basis of residual vibrations of the vibrating plate 630. One end of the detection unit 48 is electrically connected to the lower electrode 631, and the other end of the detection unit 48 is electrically connected to the upper electrode 633.

FIG. 5B illustrates a curve of electromotive force (state of electromotive force) VR of the drive element 63 on the basis of residual vibrations of the vibrating plate 630 that occur after supply of the drive signal SG for discharge of the ink droplet 67 from the nozzle 64. Here, the horizontal axis indicates time t, and the vertical axis indicates electromotive force Vf. The curve of electromotive force VR illustrates an example in which the ink droplet 67 is discharged from the normal nozzle 64. When the ink droplet 67 is not discharged from the nozzle because of obturation or the like, or the ink droplet 67 discharged does not draw a correct trajectory, a curve of electromotive force at that time is displaced from the VR. Therefore, such a detection circuit illustrated in FIG. 6A can be used to detect whether the nozzle 64 is normal or failed.

The detection unit 48 illustrated in FIG. 6A includes an amplification unit 701 and a pulse width detection unit 702. The amplification unit 701, for example, includes an op-amp 701*a*, the comparator 701*b*, capacitors C1 and C2, and resistors R1 to R5. When the drive signal SG output from the drive circuit 62 is applied to the drive element 63, residual vibrations occur, and electromotive force based on the residual vibrations is input to the amplification unit 701. Low-frequency components included in the electromotive force are removed by a high-pass filter that is configured by the capacitor C1 and the resistor R1, and the electromotive force after removal of low-frequency components is amplified by the op-amp 701*a* at a predetermined amplification rate. The output of the op-amp 701*a* passes through a high-pass filter that is configured by the capacitor C2 and the resistor R4, is compared with a reference voltage Vref by the comparator 701*b*, and is converted into a pulsed voltage with a high level H or a low level L depending on whether the output is greater than the reference voltage Vref or not.

FIG. 6B illustrates an example of the pulsed voltage that is output from the comparator 701*b* and is input to the pulse width detection unit 702. The pulse width detection unit 702 resets a count value at the time of a rise of the pulsed voltage input, increments the count value for each predetermined period, and outputs the count value to the controller 10 as a detection result at the time of the next rise of the pulsed voltage. The count value corresponds to the cycle of electromotive force based on residual vibrations, and the count values that are sequentially output indicate a frequency characteristic of electromotive force based on residual vibrations. A frequency characteristic (for example, the cycle) of electromotive force when a nozzle is the failed nozzle LN is different from a frequency characteristic of electromotive force when a nozzle is normal. Therefore, the controller 10 can determine that a nozzle of a detection target is normal when the count values that are sequentially input are within an allowable range and can determine that a nozzle of a detection target is the failed nozzle LN when the count values that are sequentially input are out of the allowable range.

By performing the above-described process for each nozzle 64, the controller 10 can understand the state of each nozzle 64 and can store information representing the position of the failed nozzle LN in, for example, the RAM 20 or the non-volatile memory 30.

Obviously, detection of the failed nozzle LN is not limited to the method described above. For example, a method of discharging the ink droplet 67 while switching a nozzle of a target sequentially from the plurality of nozzles 64 and receiving an operation input of information (for example, a nozzle number) that is used to recognize a nozzle which does not form a dot on the print material 400 is also included in the detection of the failed nozzle LN. In addition, when the information used to recognize the failed nozzle LN is stored in, for example, the non-volatile memory 30 before shipment from a manufacturing factory, the failed nozzle detection portion U3 is not necessarily disposed in the ink jet printer 1.

FIG. 7 schematically illustrates an example in which the discharge timing of the ink droplet 67 is displaced in the drive signal transmission unit 45. A drive circuit 221 that applies a voltage signal to a drive element for discharging ink droplets from the first array #1 of the nozzles 64 and a drive circuit 222 that applies a voltage signal to a drive element for discharging ink droplets from the second array #2 of the nozzles 64 are disposed in the head 61 illustrated in FIG. 7. These drive circuits 221 and 222 are included in the drive circuit 62 illustrated in FIG. 3 and the like. The drive signal transmission unit 45 includes a reference signal generation circuit 210 (discharge interval control unit U21), a delay circuit 211 for the first array #1 (discharge delay unit U22), and a delay circuit 212 for the second array #2.

The reference signal generation circuit 210 generates a reference timing signal RTS with a predetermined discharge interval, for example, an interval in which the pitch of the dot DT is 1/1200 inch in the scanning direction D2 and supplies the reference timing signal RTS to the delay circuits 211 and 212. The delay circuit 211 for the first array #1 generates a printing timing signal PTS1 on the basis of the reference timing signal RTS by delaying the timing of the reference timing signal RTS and supplies the printing timing signal PTS1 to the drive circuit 221. The delay circuit 212 for the second array #2 generates a printing timing signal PTS2 on the basis of the reference timing signal RTS by delaying the timing of the reference timing signal RTS and supplies the printing timing signal PTS2 to the drive circuit 222. Here, the delay circuit 211 for the first array #1 generates the printing timing signal PTS1 by delaying the timing of the reference timing signal RTS in a manner in which the position of the dot DT formed by the first array #1 of the nozzles is further on a downstream side (right side in FIG. 7) of the scanning direction D2 than the position of the dot DT formed by the second array #2 of the nozzles within a range that is smaller than the size of one pixel (for example, 1/2400 inch). The drive circuit 221 for the first array #1 applies a voltage signal to a drive element in accordance with a drive signal SG1 that is input from the controller 10. The drive circuit 222 for the second array #2 applies a voltage signal to a drive element in accordance with a drive signal SG2 that is input from the controller 10. These drive signals SG1 and SG2 are included in the drive signal SG illustrated in FIG. 2 and the like.

According to the description above, the reference signal generation circuit 210 controls the discharge timing of the ink droplet 67 from the plurality of nozzles 64 to be within a predetermined discharge interval. The delay circuit 211 for the first array #1 delays the discharge timing of ink droplets from the primary vicinal nozzles RN1 and RN2 from a timing at which the hitting positions of ink droplets from both the arrays#1 and#2 of the nozzles meet in the scanning direction D2 within the range of the discharge interval. When the pixel constituting the print image is the expected hitting position of an ink droplet, a pixel PX11 that corresponds to the first array #1 of the nozzles is displaced further to the downstream side than a pixel PX12 that corresponds to the second array #2 of the nozzles within the range that is smaller than the size of one pixel as illustrated in FIG. 7. When the failed nozzle LN exists in the first array #1, the position of dots formed by ink droplets from the primary vicinal nozzles RN1 and RN2 in the scanning direction D2 is displaced to the downstream side from the position of dots formed by ink droplets from the secondary vicinal nozzles RN3 and RN4 in the scanning direction D2 within the range that is smaller than the size of one pixel.

The displacement of the pixels PX11 and PX12 in the scanning direction D2 is half the pitch of the pixel and, for example, is preferably 1/2400 inch when the resolution is 1200 dpi. However, the displacement may be one-fourth to one-third of the pitch of the pixel, not limited to half the pitch of the pixel. If the effect of complementation is sufficiently obtained when the displacement of the pixels PX11 and PX12 is smaller than half the pitch of the pixel, the quality of the print image is improved when compared with that in a case where the displacement is half the pitch of the pixel. Thus, the displacement being smaller than half the pitch of the pixel is preferable. Accordingly, the drive signal transmission unit 45 may include a delay control unit 213 that changes the amount of delay of the timing of the reference timing signal RTS by the delay circuits 211 and 212 as illustrated in parentheses in FIG. 7. Therefore, the amount of delay of the discharge timing of an ink droplet can be variously set within the discharge interval by considering the quality and the like of the print image.

3. Description of Printing Process in First Specific Example

Each of the units 41 to 45 and 50 described above sequentially performs a process of forming the print image 330 on the basis of the input image from the host apparatus 100, the memory card 90, or the like. The printing process may be realized by an electrical circuit or may be realized by a program. Here, a process performed by the complemental unit 44 corresponds to a complementing process, and a process performed by the drive signal transmission unit 45 and the mechanism unit 50 corresponds to a dot forming process.

Figure 8:
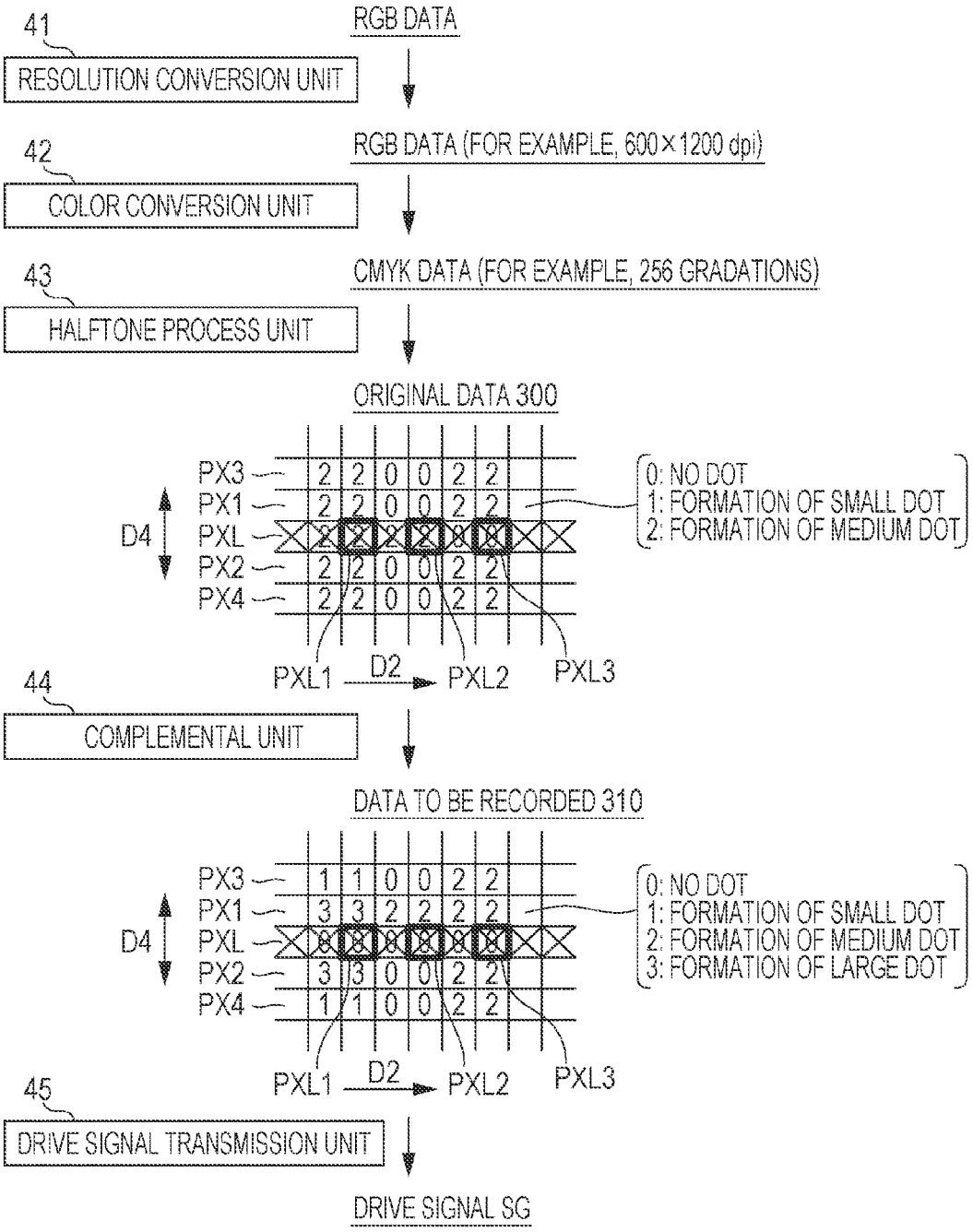
FIG. 8 is a diagram schematically illustrating a flow of a printing process.

FIG. 8 schematically illustrates a flow of the printing process. When the printing process is started, the resolution conversion unit 41 converts RGB data (for example, 256 gradations) representing the input image into a set resolution (for example, 600×1200 dpi). The color conversion unit 42 converts the RGB data of the set resolution into CMYK data (for example, 256 gradations) of the same set resolution in color. The halftone process unit 43 performs a halftone process on the CMYK data to generate the original data 300 of the same set resolution. The original data 300 illustrated in FIG. 8 is four-value data but is multi-value data in which a large dot is not formed. The complemental unit 44 performs a predetermined complementing process on the original data 300 to generate the data to be recorded 310 of the same set resolution. The data to be recorded 310 is four-value data in which a large dot is formed as at least a part of a complemental dot.

The complementing process, for example, can be performed in accordance with the following rules. The pixels PXL, and PX1 to PX4 in the rules mean pixels at the same position in the scanning direction D2.

Rule 1: When both the pixels PXL and PX1 of the original data 300 are "1" (formation of a small dot) or "2" (formation of a medium dot), add one to the data of the adjacent pixel PX1, and change the dot-missing pixel PXL to "0" (no dot). When the adjacent pixel PX1 after complementation is "3"

(formation of a large dot), and "2" is stored in the secondary adjacent pixel PX3 of the original data 300, change the secondary adjacent pixel PX3 to "1".

Rule 2: When both the pixels PXL and PX2 of the original data 300 are "1" or "2", add one to the data of the adjacent pixel PX2, and change the dot-missing pixel PXL to "0". When the adjacent pixel PX2 after complementation is "3", and "2" is stored in the secondary adjacent pixel PX4 of the original data 300, change the secondary adjacent pixel PX4 to "1".

Rule 3: When, in the original data 300, the dot-missing pixel PXL is "1" or "2", and both the adjacent pixels PX1 and PX2 are "0", change the adjacent pixel PX1 to the data of the dot-missing pixel PXL, and change the dot-missing pixel PXL to "0".

Rule 4: When the dot-missing pixel PXL of the original data 300 is "0", do not change the data of the pixels PXL and PX1 to PX4.

Assume that, for example, a dot-missing pixel PXL1 is "2" (formation of a medium dot), and the adjacent pixel PX1 that is adjacent to the dot-missing pixel PXL1 is also "2" in the original data 300. In this case, in the data to be recorded 310 after passing through the complementing process, the dot-missing pixel PXL1 is "0" (no dot), and the adjacent pixel PX1 that is adjacent to the dot-missing pixel PXL1 is "3" (formation of a large dot). The large dot is a complemental dot, changed from a medium dot. The secondary adjacent pixel PX3 that is adjacent to the adjacent pixel PX1 is changed from "2" to "1" (formation of a small dot) in the original data 300.

In addition, assume that a dot-missing pixel PXL2 is "2", and the adjacent pixel PX1 that is adjacent to the dot-missing pixel PXL2 is "0" in the original data 300. In this case, in the data to be recorded 310 after passing through the complementing process, the dot-missing pixel PXL2 is "0", and the adjacent pixel PX1 that is adjacent to the dot-missing pixel PXL2 is "2" (formation of a medium dot). The medium dot that is newly formed is a complemental dot.

Furthermore, assume that a dot-missing pixel PXL3 is "0", and the adjacent pixel PX1 that is adjacent to the dot-missing pixel PXL3 is "2" in the original data 300. In this case, in the data to be recorded 310 after passing through the complementing process, the dot-missing pixel PXL3 is "0" without change, and the adjacent pixel PX1 that is adjacent to the dot-missing pixel PXL3 is "2" without change.

Accordingly, the data to be recorded 310 is data in which dots are complemented in the adjacent pixels PX1 and PX2.

Obviously, the present technology is not limited to the rules described above. For example, the adjacent pixel PX1 may be changed to "3" in the Rule 1, and the adjacent pixel PX2 may be changed to "3" in the Rule 2.

The drive signal transmission unit 45 generates the drive signal SG from the data to be recorded 310 and outputs the drive signal SG to the drive circuit 62. At this time, the drive signals SG1 and SG2 included in the drive signal SG are respectively output to the drive circuits 221 and 222 as illustrated in FIG. 7. The delay circuit 212 for the second array #2 generates the printing timing signal PTS2 by delaying the timing of the reference timing signal RTS by a predetermined period and outputs the printing timing signal PTS2 to the drive circuit 222. The drive circuit 222 applies a voltage signal to the drive element 63 for the second array #2 in accordance with the drive signal SG2 and allows the nozzles 64 in the second array #2 to discharge the ink droplet 67 first. Accordingly, an ink droplet corresponding to the size represented in the data to be recorded 310 first hits the pixel PX12 in the second array #2, and a dot corresponding to the size is formed. The delay circuit 211 for the first array #1 generates the printing timing signal PTS1 by delaying the timing of the reference timing signal RTS in a manner in which the position of the dot DT formed by the first array #1 of the nozzles is further on the downstream side of the scanning direction D2 than the position of the dot DT formed by the second array #2 of the nozzles within the range that is smaller than the size of one pixel and outputs the printing timing signal PTS1 to the drive circuit 221 for the first array #1. The drive circuit 221 applies a voltage signal to the drive element 63 for the first array #1 in accordance with the drive signal SG1 and allows the first array #1 of the nozzles 64 to discharge the ink droplet 67 subsequently. Accordingly, an ink droplet corresponding to the size represented in the data to be recorded 310 is delayed and hits the pixel PX11 in the first array #1, and a dot corresponding to the size is formed.

According to the above description, the position of the dots DT1 and DT2 formed by ink droplets from the primary vicinal nozzles in the scanning direction D2 and the position of the dots DT3 and DT4 formed by ink droplets from the secondary vicinal nozzles in the scanning direction D2 are displaced. An example of the print image 330 formed is schematically illustrated in FIG. 1. The dots DT1 and DT2 formed in the adjacent pixels PX1 and PX2 are hatched. As illustrated in FIG. 1, the hitting position of ink droplets in the adjacent areas A1 and A2 and the hitting position of ink droplets in the secondary adjacent areas A3 and A4 are displaced in the scanning direction D2. Thus, the amount of interference between the dots DT1 and DT2 in the adjacent areas A1 and A2 and the dots DT3 and DT4 in the secondary adjacent areas A3 and A4 is decreased. This suppresses ink droplets that hit the adjacent areas A1 and A2 being attracted by ink droplets that hit the secondary adjacent areas A3 and A4 and widened toward the secondary adjacent areas A3 and A4, and the dot-missing area AL is easily covered by the complemental dots DT1 and DT2 formed in the adjacent pixels PX1 and PX2. In addition, when the discharge timing of ink droplets from the primary vicinal nozzles RN1 and RN2 is delayed within the range of the discharge interval, the difference between the time of hitting of ink droplets in the adjacent areas A1 and A2 and the secondary adjacent areas A3 and A4 is increased, and from this point, ink droplets that hit the adjacent areas A1 and A2 are hardly attracted by ink droplets that hit the secondary adjacent areas A3 and A4. Therefore, the present technology can suppress streaking in the print image along the dot-missing area AL and can improve the effect of complementing dots that have to be formed by the failed nozzle LN. The effect is noticeably obtained when a plurality of nozzles is arranged in a zigzag form.

In addition, since the discharge interval control unit U21 and the discharge delay unit U22 exist, the present technology can maintain the speed of the printing process without increasing the resolution of the data to be recorded 310 and can set the amount of delay of the discharge timing variously by considering the quality and the like of the print image.

As described above, the effect of complementation is improved when each of the positions of dots formed in the adjacent area and the secondary adjacent area is displaced in the scanning direction. Therefore, when, for example, the timing of the printing timing signal can be changed in units of one nozzle, only the discharge timing of ink droplets from the primary vicinal nozzles RN1 and RN2 may be delayed within the range of the discharge interval. Accordingly, the position of dots formed in the adjacent areas A1 and A2 in the scanning direction D2 is displaced to the downstream side from the position of dots formed in the entire remaining area in the scanning direction D2 within the range that is smaller than the size of one pixel.

4. Description of Printing Process in Specific Example

Even without the delay circuit 211 illustrated in FIG. 7, each of the positions of dots formed by ink droplets from the primary vicinal nozzles and the secondary vicinal nozzles in the scanning direction can be displaced. For example, the resolution for control of formation of a dot in the scanning direction may be double the resolution of the data to be recorded 310, and each of the positions of formation of dots in the adjacent area and the secondary adjacent area in the scanning direction may be displaced by the multiplicative inverse of the resolution for control through a data process regarding the data to be recorded 310.

FIG. 9 schematically illustrates a flow of a data conversion process that is performed in the data conversion unit U23 disposed in the drive signal transmission unit 45. As assumptions on the data conversion process, the ink jet printer 1 includes the configuration illustrated in FIGS. 1 to 5 and 8, and the data to be recorded 310 with the first resolution (for example, 1200 dpi) in the scanning direction D2 is generated through processes by each of the units 41 to 44 described above.

First, the data conversion unit U23 generates intermediate data 311 on the basis of the data to be recorded 310 by lining up four-value data for each pixel of the data to be recorded 310 continuously by two pixels in the scanning direction D2 and converting the first resolution into the second resolution (for example, 2400 dpi) which is double the first resolution in the scanning direction D2. When, for example, the pixel PX1*a* of the data to be recorded 310 of the resolution 1200 dpi in the scanning direction is "3" (formation of a large dot), two pixels PX1*b* and PX1*c* that correspond to the pixel PX1*a* in the intermediate data 311 of the resolution 2400 dpi in the scanning direction are "3".

Next, the data conversion unit U23 generates the second data to be recorded 320 of the resolution 2400 dpi in the scanning direction, the second data to be recorded 320 in which the data of each pixel (each original pixel) of the data to be recorded 310 is arranged for every two pixels in the scanning direction (D2), and data for not forming a dot is arranged in the remaining pixels by an AND operation of a mask pattern 312 having a data arrangement in a checkered form and the intermediate data 311. The mask pattern 312, for example, is pattern data in which "1" and "0" are alternately arranged in pixels that are orderly lined up in each of the scanning direction D2 and the width direction D4. That is, the values of adjacent pixels in the scanning direction D2 are different from each other, and the values of adjacent pixels in the width direction D4 are different from each other. Here, "1" means that the data of an overlaid pixel in the intermediate data 311 remains, and "0" means that an overlaid pixel in the intermediate data 311 is set to "0". In addition, the mask pattern 312 is pattern data for conversion of the intermediate data 311 into the second data to be recorded 320 in a manner in which the position of data for each pixel of the data to be recorded 310 in the first array #1 is set to a position at which a dot is formed later than that formed at the position of data for each pixel of the data to be recorded 310 in the second array #2. When the primary vicinal nozzles RN1 and RN2 are included in the first array #1 of the nozzles, and the secondary vicinal nozzles RN3 and RN4 are included in the second array #2 of the nozzles, the second data to be recorded 320 is generated from the intermediate data 311 in a manner in which the position of data for each pixel of the data to be recorded 310 in the adjacent pixels PX1 and PX2 is set to a position at which a dot is formed later than that at the position of data for each pixel of the data to be recorded 310 in the secondary adjacent pixels PX3 and PX4.

When, for example, the adjacent pixels PX1*b* and PX1*c* of the intermediate data 311 are "3", the adjacent pixel PX1*b* at a position where a dot is formed first in the intermediate data 311 is converted into "0", and an adjacent pixel PX1*d* of the second data to be recorded 320 is "0". The adjacent pixel PX1*c* at a position where a dot is formed subsequently in the intermediate data 311 remains to be "3", and an adjacent pixel PX1*e* of the second data to be recorded 320 is "3".

According to the above description, the data conversion unit U23 generates the second data to be recorded 320 of the resolution 2400 dpi in the scanning direction on the basis of the data to be recorded 310 by arranging the data of each pixel of the data to be recorded 310 for every two pixels in the scanning direction D2, arranging data for not forming a dot in the remaining pixels, and setting the position of data for each pixel of the data to be recorded 310 in the adjacent pixels PX1 and PX2 to a position at which a dot is formed later than that formed at the position of data for each pixel of the data to be recorded 310 in the secondary adjacent pixels PX3 and PX4. The drive signal transmission unit 45 generates the drive signal SG from the second data to be recorded 320 and outputs the drive signal SG to the drive circuit 62. Here, the speed of transport of the print material 400 in the transport direction D3 is set by half when compared with that in the case of 1200 dpi to be in accordance with the change of the pitch of a dot from 1/1200 dpi to 1/2400 dpi in the scanning direction D2. Accordingly, without changing the circuit that generates the printing timing signal, ink droplets are discharged from the plurality of nozzles 64 in accordance with the second data to be recorded 320 of the resolution 2400 dpi in the scanning direction, and dots are formed.

According to the above process, dots are formed at different positions in the scanning direction D2 in the adjacent areas A1 and A2 and in the secondary adjacent areas A3 and A4 as illustrated in FIG. 1. Thus, ink droplets that hit the adjacent areas A1 and A2 are hardly attracted by ink droplets that hit the secondary adjacent areas A3 and A4. In addition, the discharge timing of subsequent ink droplets from the first array #1 of the nozzles 64 that includes the primary vicinal nozzles RN1 and RN2 is actually delayed by half the size of one pixel of the resolution 1200 dpi in the scanning direction. Thus, the difference between the time of hitting of ink droplets is increased. Accordingly, the second specific example can improve the effect of complementing dots that have to be formed by the failed nozzle LN without using a circuit that delays the discharge timing of ink droplets from the nozzles.

As described above, the effect of complementation is improved when each of the positions of dots formed in the adjacent area and the secondary adjacent area is displaced in the scanning direction. Therefore, a mask pattern that sets the position of data for each pixel of the data to be recorded 310 in the adjacent pixels PX1 and PX2 to a position at which a dot is formed later than that formed at the position of data for each pixel of the data to be recorded 310 in the all the remaining pixels may be used.

5. Modification Example

The invention is considered with various modification examples.

For example, the ink jet printer to which the present technology can be applied includes a serial printer, a photocopier, a facsimile, and the like besides the line printer. When, for example, the paper transport mechanism intermittently transports the print material in the transport direction, and the head reciprocates in a main-scanning direction that is orthogonal to the transport direction, the present technology is applied to this case with the main-scanning direction as the scanning direction in the present technology.

The color of ink may not include a part of C, M, Y, and K like one color of K and may include at least a part of light cyan (lc), light magenta (lm), dark yellow (dy), light black (lk), light light black (llk), orange (Or), green (Gr), blue (B), violet (V), and the like besides C, M, Y, and K. In addition, the ink includes not only liquids for representing colors but also various liquids that have any function such as an uncolored liquid that gives glossiness and the like. Accordingly, various droplets like uncolored droplets are included in the ink droplets.

The head to which the present technology can be applied may be a head that includes a plurality of nozzles arranged in one array for each color or the like besides the head that includes the plurality of nozzles arranged in a zigzag form for each color. The present technology also includes a case where the plurality of nozzles is arranged in one array in the width direction of the print material, and ink droplets hit the adjacent area and the secondary adjacent area at the same time. In this case, ink droplets that hit the adjacent area are hardly attracted by ink droplets that hit the secondary adjacent area because each of the positions of dots formed in the adjacent area and the secondary adjacent area in the scanning direction is displaced. Thus, the effect of complementation is improved.

Although the set resolution is 600×1200 dpi in the embodiment described above, the set resolution in the width direction D4 can be variously changed to 300 dpi, 720 dpi, or the like, and the set resolution in the scanning direction D2 can be variously changed to 600 dpi, 1440 dpi, or the like.

A method for displacing each of the position of dots formed in the adjacent area and the secondary adjacent area in the scanning direction is not limited to the method of changing the timing of the printing timing signal and generating the second data to be recorded. For example, provided that a drive wave that is supplied to the drive element 63 can be changed in units of one array of the arrays#1 and#2, a drive wave that causes the speed of discharge of ink droplets from the nozzles in the first array #1 to be slower than the speed of discharge of ink droplets from the nozzles in the second array #2 within the range that is smaller than the size of one pixel may be supplied to the drive element 63 for the first array #1. Accordingly, the position of dots formed in the adjacent areas A1 and A2 in the scanning direction is displaced further to the downstream side than the position of dots formed in the secondary adjacent areas A3 and A4 in the scanning direction within the range that is smaller than the size of one pixel.

The fundamental effect of the present technology is obtained even with an ink jet printer in which the failed nozzle detection portion U3 is not disposed.

6. Conclusion

As described above, according to the invention, a technology or the like that can improve the effect of complementing dots caused by the failed nozzle which fails to form dots can be provided in various embodiments. Obviously, the fundamental action and the effect described above are obtained in a technology or the like that does not have constituents which are in accordance with dependent claims and is formed only from constituents in accordance with independent claims.

In addition, a configuration in which the configurations disclosed in the embodiment and the modification example described above are replaced with each other, or the combination thereof is changed, a configuration in which technologies in the related art and the configurations disclosed in the embodiment and the modification example described are replaced with each other, or the combination thereof is changed, and the like can also be embodied. The invention also includes these configurations.

What is claimed is:

1. An ink jet printer having a plurality of nozzles lined up in a different direction from a moving direction in which a print material or the plurality of nozzles move relative to each other in the moving direction to form a dot using an ink droplet, the ink jet printer comprising:

a complemental unit that generates data to be recorded in which a dot is complemented in an adjacent pixel on the basis of original data before complementation of a dot to be formed by a failed nozzle; and a dot formation unit that forms dots by allowing the plurality of nozzles to discharge an ink droplets on the basis of the data to be recorded, wherein the plurality of nozzles includes the failed nozzle that fails to discharge an ink droplet, a primary vicinal nozzle that forms a dot in the adjacent pixel which is adjacent in a direction intersecting the moving direction to a dot-missing pixel which is caused by the failed nozzle and is continuous in the moving direction, and a secondary vicinal nozzle that forms a dot in a secondary adjacent pixel which is adjacent to the adjacent pixel on the opposite side of the adjacent pixel from the dot-missing pixel, the dot formation unit forms dots by displacing the position of a dot formed by an ink droplet from the primary vicinal nozzle in the moving direction and the position of a dot formed by an ink droplet from the secondary vicinal nozzle in the moving direction, and the dot formation unit controls a discharge timing of an ink droplet from the plurality of nozzles within a discharge interval, and delays a discharge timing of an ink droplet from the primary vicinal nozzle within the range of the discharge interval.

2. The ink jet printer according to claim 1, wherein the dot formation unit includes a discharge interval control unit that controls the discharge timing of an ink droplet from the plurality of nozzles within the predetermined discharge interval, and a discharge delay unit that delays the discharge timing of an ink droplet from the primary vicinal nozzle within the range of the discharge interval.

3. The ink jet printer according to claim 2, wherein the plurality of nozzles is arranged in a zigzag form as a first array of nozzles and a second array of nozzles from which an ink droplet is discharged earlier than from the first array of nozzles, the primary vicinal nozzle is included in the first array of nozzles, the secondary vicinal nozzle is included in the second array of nozzles, and the discharge delay unit delays a discharge timing of an ink droplet from the first array of nozzles within the range of the discharge interval.

4. The ink jet printer according to claim 1, wherein the complemental unit generates the data to be recorded that has a first resolution in the moving direction on the basis of the original data, the dot formation unit includes a data conversion unit that generates second data to be recorded on the basis of the data to be recorded by converting the first resolution into a second resolution which is double the first resolution in the scanning direction by continuously lining up each pixel of the data to be recorded in the moving direction, arranging the original data of each pixel for every two pixels in the moving direction and arranging data for not forming a dot in the remaining pixels, and setting the positions of the original data for each pixel in the adjacent pixel and the secondary adjacent pixel to positions that are different from each other in the moving direction, and forms a dot by discharging an ink droplet from the plurality of nozzles in accordance with the second data to be recorded that has the second resolution in the moving direction.

5. The ink jet printer according to claim 4, wherein the plurality of nozzles is arranged in a zigzag form as a first array of nozzles and a second array of nozzles from which an ink droplet is discharged earlier than from the first array of nozzles, the primary vicinal nozzle is included in the first array of nozzles, the secondary vicinal nozzle is included in the second array of nozzles, and the data conversion unit generates the second data to be recorded by setting the position of the original data for each pixel in the adjacent pixel to a position at which a dot is formed later than a dot formed at the position of the original data for each pixel in the secondary adjacent pixel.

6. The ink jet printer according to claim 1, wherein the ink jet printer is a line printer in which an ink droplet is discharged from the plurality of nozzles to the print material.

7. A recording method having a plurality of nozzles lined up in a different direction from a moving direction in which a print material or the plurality of nozzles move relative to each other in the moving direction to form a dot using an ink droplet, the recording method comprising:

complementing by generating data to be recorded in which a dot is complemented in an adjacent pixel on the basis of original data before complementation of a dot to be formed by a failed nozzle; and dot forming by forming dots by allowing the plurality of nozzles to discharge an ink droplets on the basis of the data to be recorded, wherein the plurality of nozzles includes the failed nozzle that fails to discharge an ink droplet, a primary vicinal nozzle that forms a dot in the adjacent pixel which is adjacent in a direction intersecting the moving direction to a dot-missing pixel which is caused by the failed nozzle and is continuous in the moving direction, and a secondary vicinal nozzle that forms a dot in a secondary adjacent pixel which is adjacent to the adjacent pixel on the opposite side of the adjacent pixel from the dot-missing pixel, in the dot forming, dots are formed by displacing the position of a dot formed by an ink droplet from the primary vicinal nozzle in the moving direction and the position of a dot formed by an ink droplet from the secondary vicinal nozzle in the moving direction, and in the dot forming, controlling a discharge timing of an ink droplet from the plurality of nozzles within a discharge interval, and delaying a discharge timing of an ink droplet from the primary vicinal nozzle within the range of the discharge interval.

8. An ink jet printer having a plurality of nozzles lined up in a different direction from a moving direction in which a print material or the plurality of nozzles move relative to each other in the moving direction to form a dot using an ink droplet, the ink jet printer comprising:

a complemental unit that generates data to be recorded in which a dot is complemented in an adjacent pixel on the basis of original data before complementation of a dot to be formed by a failed nozzle; and a dot formation unit that forms dots by allowing the plurality of nozzles to discharge an ink droplets on the basis of the data to be recorded, wherein the plurality of nozzles includes the failed nozzle that fails to discharge an ink droplet, a primary vicinal nozzle that forms a dot in the adjacent pixel which is adjacent in a direction intersecting the moving direction to a dot-missing pixel which is caused by the failed nozzle and is continuous in the moving direction, and a secondary vicinal nozzle that forms a dot in a secondary adjacent pixel which is adjacent to the adjacent pixel on the opposite side of the adjacent pixel from the dot-missing pixel, and the dot formation unit forms dots by increasing each time between when the primary vicinal nozzle forms a dot and when the secondary vicinal nozzle forms a dot.

9. An ink jet printer having a plurality of nozzles lined up in a different direction from a moving direction in which a print material or the plurality of nozzles move relative to each other in the moving direction to form a dot using an ink droplet, the ink jet printer comprising:

a complemental unit that generates data to be recorded in which a dot is complemented in an adjacent pixel on the basis of original data before complementation of a dot to be formed by a failed nozzle; and a dot formation unit that forms dots by allowing the plurality of nozzles to discharge an ink droplets on the basis of the data to be recorded, wherein the plurality of nozzles includes the failed nozzle that fails to discharge an ink droplet, a primary vicinal nozzle that forms a dot in the adjacent pixel which is adjacent in a direction intersecting the moving direction to a dot-missing pixel which is caused by the failed nozzle and is continuous in the moving direction, and a secondary vicinal nozzle that forms a dot in a secondary adjacent pixel which is adjacent to the adjacent pixel on the opposite side of the adjacent pixel from the dot-missing pixel, and the dot formation unit forms dots by widening each gap between a position where the primary vicinal nozzle forms a dot and a position where the secondary vicinal nozzle forms a dot.

* * * * *